US006207332B1

(12) United States Patent
Nakayama et al.

(10) Patent No.: US 6,207,332 B1
(45) **Date of Patent: *Mar. 27, 2001**

(54) PROCESS FOR PRODUCING LITHOGRAPHIC PRINTING PLATE

(75) Inventors: Takao Nakayama; Shigeyuki Dan; Ryousuke Itakura; Hideyuki Hattori; Hiroshi Tashiro, all of Shizuoka (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/988,282

(22) Filed: Dec. 10, 1997

(30) Foreign Application Priority Data

Dec. 28, 1996 (JP) ..... 8-358409
Jan. 31, 1997 (JP) ..... 9-033353

(51) Int. Cl.[7] ..... G03G 13/02; G03G 13/28

(52) U.S. Cl. ..... 430/49; 430/56; 430/69; 430/902

(58) Field of Search ..... 430/49, 62, 63, 430/69, 902, 56; 101/467, 466; 399/170

(56) References Cited

U.S. PATENT DOCUMENTS 3,866,096 * 2/1975 Metcalfe et al. ..... 317/262
6,022,654 * 2/2000 Nakayama et al. ..... 430/31

FOREIGN PATENT DOCUMENTS 387448 5/1965 (CH) .
1295886 11/1962 (FR) .
2201491 4/1974 (FR) .
912836 * 12/1962 (GB) .
912845 12/1962 (GB) .
1006117 * 9/1965 (GB) .
995491 * 6/1996 (GB) .

OTHER PUBLICATIONS

Patent Abstracts of Japan, vol. 15, No. 245, & JP 03 077981A—Matsushita, published Aug. 21, 1989.

Patent Abstracts of Japan, vol. 7, No. 15 & 57 171356 A (Ricoh), published Oct. 21, 1982.

* cited by examiner

*Primary Examiner*—Janis L. Dote
(74) *Attorney, Agent, or Firm*—Reed Smith LLP

(57) ABSTRACT

A process for producing a lithographic printing plate which is inexpensive, is not elongated, can be readily handled and can provide a uniform image, is disclosed. The process comprises the steps of:

using an original plate for lithographic printing comprising a support having a volume electric resistance of more than $1\times10^{10}$ Ω·cm, a conductive layer having a volume electric resistance of $1\times10^{5}$ Ω·cm or less, provided on one surface of the support, and a photoconductive layer containing zinc oxide and a binder, provided on the conductive layer, conducting negative corona discharge from the side of the photoconductive layer of the original plate for lithographic printing, and during this corona discharge, contacting a conductor having earth potential with at least the support of the original plate, thereby charging the photoconductive layer of the original plate for lithographic printing.

1 Claim, 2 Drawing Sheets

PROCESS FOR PRODUCING LITHOGRAPHIC PRINTING PLATE

BACKGROUND OF THE INVENTION

The present invention relates to a process for producing a lithographic printing plate. More specifically, it relates to a process for producing a lithographic printing plate using an electrophotographic method, which can suppress non-uniform charging to thereby obtain a desirable toner image having low fogging.

A conventional process for producing a lithographic printing plate by an electrophotographic method comprises corona-charging an original plate for lithographic printing comprising a water-resistant support having a layer containing zinc oxide and a binder provided thereon, imagewise exposing, toner developing, fixing and etching.

The above-described water resistant support used is a paper to which water resistant property has been imparted, metal foil, or the composite thereof.

Where a paper is used as the support, in order to impart conductivity to the paper, a so-called conductive agent, such as a coating liquid containing an inorganic electrolyte such as sodium chloride, potassium chloride or calcium chloride, or an organic polymer electrolyte such as quaternary ammonium, is used and a paper is impregnated or coated therewith. In this case, the paper is adjusted so as to have a volume electric resistance of about $1\times10^9$ Ω·cm.

However, where an original plate for lithographic printing is produced using the paper having been subjected to such a conductivity treatment as a substrate, even if a water resistance treatment has been applied to the paper, due to addition of dampening water during printing, the paper is inevitably partially elongated on a roll during printing, viz., the plate elongation cannot be avoided. Thus, various problems may occur during printing such that wrinkles happen on backedge and resister changes by slipping of printing plate during printing.

As a structure for protecting the paper support from water influence, it has been attempted to use a paper support having, for example, a conductive filler-containing polyethylene layer, laminated thereon i.e., to use a conductive laminate paper, as described in, for example, JP-A-58-57994 and 59-64395 (The term "JP-A" as used herein means an "unexamined published Japanese patent application").

However, such a laminate paper involves the disadvantages that a conductive treatment must be applied to a paper support or a resin film, so that the production cost of the support increases, which may undesirably invite high cost of the entire printing plate.

Further, it has been attempted to use a paper having a metal foil, such as aluminum, zinc or copper, adhered thereon (hereinafter referred to as a "metal foil laminate paper") as described in, for example, JP-B-38-17249, 41-2426 and 41-12432 (The term "JP-B" as used herein means an "examined published Japanese patent publication"). In any case, a paper which is impregnated with the above-described conductive agent is used as a paper to be laminated.

When this metal foil laminate paper is used, a paper must be subjected to a conductive treatment. Further, a metal foil is required to adhere to one side or both sides of the paper. Thus, this attempt has the disadvantage that a production cost is higher than that in the above-described laminate paper.

In this case, it is considered to use a support obtained by forming a conductive layer such as a metal foil on an ordinary base such as a polyester base or a polyethylene laminate paper and further forming a photoconductive layer thereon. However, such a support, although being inexpensive, has a low conductivity as the entire support, so that it cannot be practically used. This point will be explained below.

In a lithographic printing plate by an electro-photographic method, the plate is produced according to a plate making method as shown in FIG. 4 that corona charge is applied to both sides of the original plate. In this drawing, master 1' is charged negatively and positively above and below the photoconductive layer by a negative corona discharge unit 12 and a positive corona discharge unit 19, respectively, prior to entering an exposure part 20. In the exposure part 20, the charged master 1' is exposed to imagewise exposure, so that the charge in the exposed area disappears by the conduction of the photoconductive layer, remaining only in the unexposed area. Thus, a static latent image is formed.

However, in the plate making method having the construction as shown in FIG. 4, if a support has a low conductivity, a discharge phenomenon does not occur well, so that an image deteriorates. It is considered that a conductive layer is directly contacted with a conductor so as to ground, thereby charging. In the case of a lithographic printing plate, however, the plate is not repeatedly used, and a fresh plate is always used. Therefore, it is mechanically impossible that the conductor is directly contacted with the conductive layer interposed between a support and a photoconductive layer.

In the plate making method shown in FIG. 4, exposing light irradiated from a light source is condensed by the lens 18 in the exposure part 20. The condensed exposing light forms an image on the master 1' located in the exposure part 20 between guide rollers 15 and 16, which was supplied from the paper supply part 11 by a carrying means and was subjected to the above-described charging treatment. The master 1' is imagewise exposed form an image. This master 1' which has been exposed to light is carried to the developing and fixing part 17 by a carrying means, where toner is adhered to the unexposed part, followed by development. The developed image is fixed, subjected to a desensitizing treatment, and dried to produce the lithographic printing plate.

SUMMARY OF THE INVENTION

Accordingly, an object of the present invention is to provide a process for producing a lithographic printing plate which is inexpensive, is not elongated, can be readily handled and can provide a uniform image.

The above-described object can be achieved by the following constitution.

The process for producing a lithographic printing plate according to the present invention comprises the steps of:

using an original plate for lithographic printing comprising a support having a volume electric resistance of more than $1\times10^{10}$ Ω·cm, a conductive layer having a volume electric resistance of $1\times10^5$ Ω·cm or less, provided on one surface of the support, and a photoconductive layer containing zinc oxide and a binder, provided on the conductive layer, conducting negative corona discharge from the side of the photoconductive layer of the original plate for lithographic printing, and during this corona discharge, contacting a conductor having earth potential with at least the support of the original plate, thereby charging the photoconductive layer of the original plate for lithographic printing.

Thus, it has been found in the present invention that even if a support itself has a low conductivity of a volume electric resistance of more than $1\times10^{10}$ Ω·cm, if a conductive layer is provided between a support and a photoconductive layer and a conductor having an earth potential is contacted with the back side of the support, a necessary charge can be obtained by the discharge between them. The present invention has been completed based on this finding.

DETAILED DESCRIPTION OF THE INVENTION

Figure 1:
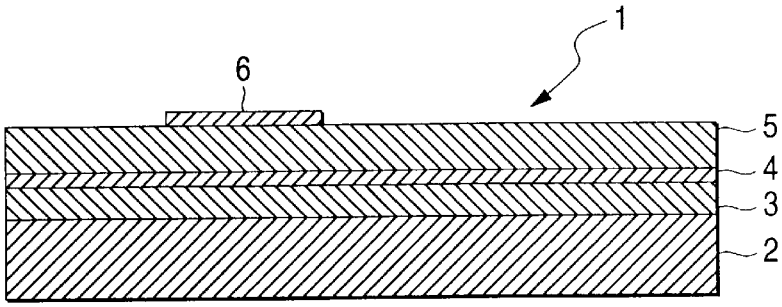
FIG. 1 is a cross sectional view showing the structure of the lithographic printing plate according to the present invention.

The present invention is described in detail below.

The process for producing a lithographic printing plate according to the present invention uses an original plate for lithographic printing comprising a water-resistant support having a volume electric resistance of more than $1\times10^{10}$ Ω·cm, a conductive layer having a volume electric resistance of $1\times10^{5}$ Ω·cm or less provided on one surface of the support, and a photoconductive layer containing zinc oxide and a binder, provided on the conductive layer. A negative corona discharge is conducted from the side of the photoconductive layer of the original plate for lithographic printing, and during this corona discharge, a conductor having earth potential is contacted with at least the support of the original plate for lithographic printing, thereby charging the original plate for lithographic printing. The support used herein means a material such as a laminate paper, a resin material or the like, which does not include a photosensitive layer, a blocking layer, a conductive layer and a back coat layer, which will be described hereinbelow.

Examples of the support having a volume electric resistance of more than $1\times10^{10}$ Ω·cm include polyamide, polyolefin, ethylacrylate-ethylmethacrylate copolymer, acrylonitrile-methyl methacrylate copolymer, amylose acetate, styrene-butadiene copolymer, polycarbonate, polyvinyl formate, poly-p-chlorostyrene, polyvinyl acetate, polydimethyl siloxane, polystyrene, polyethyl acrylate, polyacrylonitrile, polyacenaphthylene, 1,4-polyisoprene, poly-p-isopropyl styrene, polyethylene terephthalate, polyethylene naphthalate, polyethylene, polyvinyl chloride, polyoxymethylene, polypropylene oxide, polyisobutyl methacrylate, polyethyl methacrylate, poly 2-ethylbutyl methacrylate, poly n-butyl methacrylate, polymethyl methacrylate, poly n-lauryl methacrylate, poly-α-methylstyrene, poly-p-methylstyrene, poly-o-methoxystyrene, poly-p-methoxystyrene, polystyrene, polytetrahydrofuran, polyvinyl alcohol, poly-N-vinylcarbazole, poly-1-vinylnaphthalene, poly-2-vinylnaphthalene, polyvinylbiphenyl, poly-2-vinylpyridine, polyphenylene oxide, polybutadiene, polybutene, polybutene oxide, polypropylene, and a resin film comprising these polymers as its material. Of those, polyethylene terephthalate (PETP) resin film is most preferable. Further, the support wherein a resin selected from the above-described resins is laminated on a paper, i.e., a so-called a double-sided laminate, can also be used. Of those, a polyethylene laminate paper is particularly preferable. Where a laminate paper is used, it is preferable to use a paper support and a laminate resin, which are not subjected to a conductive treatment, from the standpoints of a production cost and durability,.

The support has an electric resistance of more than $1\times10^{10}$ Ω·cm, and preferably $1\times10^{11}$ Ω·cm or more. Although the upper limit of the electric resistance is not particularly limited, it is generally $1\times10^{17}$ Ω·cm or less. If the electric resistance is more than $1\times10^{10}$ Ω·cm, discharge phenomenon causes in an atmosphere between a conductive layer and a conductor described below in corona discharging from the side of the photoconductive layer, so that rapid charging can be effected. That is, the charging time can be shortened. The support has a thickness of preferably 75 to 200 μm, more preferably 120 to 180 μm, and most preferably about 150 μm. If the thickness of the support is too large, an intensive discharge destruction phenomenon is liable to occur in edge part of the support during corona discharging, and a photoconductive layer may be burnt out by Joule-heating of electric energy on corona discharging. On the other hand, if the thickness thereof is too small, strength and durability which are essential for the support are insufficient. These materials have a water resistance themselves.

Where a laminate paper is used, the thickness of a paper support is 50 to 150 μm, and preferably 65 to 146 μm. The thickness of a laminate resin is 15 to 30 μm. Specifically, when the thickness of the paper is 146 μm, the thickness of the resin is preferably 27 μm, and when the thickness of the paper is 65 μm, the thickness of the resin is preferably 19 μm. In order to improve the adhesion between the laminate layer and the paper support, it is preferable to previously coat the support with polyethylene derivatives such as ethylene vinyl acetate copolymer, ethylene-acrylate copolymer, ethylene-methacrylate copolymer, ethylene-acrylic ester copolymer, ethylene-methacrylic acid copolymer, ethylene-acrylonitrile-acrylic acid copolymer and ethylene-acrylonitrile-methacrylic acid copolymer. Alternatively, it is preferable that the surface of the support is previously subjected to the corona discharge treatment. Further, a surface treatment described in JP-A-49-24126, 52-36176, 52-121683, 53-2612 and 54-111331, and JP-B-51-25337 can also be applied to the above support.

The conductive layer which is provided on the support has an electric resistance of $1\times10^{5}$ Ω·cm or less, preferably $1\times10^{4}$ Ω·cm or less, and more preferably $1\times10^{3}$ Ω·cm or less. Although the lower limit of the electric resistance is not particularly limited, it is generally about $1\times10^{2}$ Ω·cm. Although not particularly limited, such a material having an electric resistance of $1\times10^{5}$ Ω·cm or less is materials which are made to have the above electric resistance by adding a conductive agent to a binder for the above-described resins. Examples of such a conductive agent include carbon black; colloidal silica; colloidal alumina; metals such as aluminum, zinc, silver, iron, copper, titanium, manganese, cobalt and palladium; chlorides, oxides, bromides of these metals; metal salts thereof such as sulfates, nitrates and oxalates; alkyl phosphoric acid, alkanolamine salt, polyoxyethylene alkyl phosphate, polyoxyethylene alkyl ether, alkyl methyl ammonium salt, N-N-bis(2-hydroxyethyl) alkylamine, alkyl sulfonate, alkyl benzene sulfonate, aliphatic acid choline ester, polyoxyethylene alkyl ether and its phosphates and salts, aliphatic acid monoglyceride, aliphatic acid sorbitan partial ester; cationic high molecular weight electrolytes, primary such as secondary and tertiary ammonium salts, e.g., polyethyleneimine hydrochloride and poly (N-methyl-4-vinylpyridinium chloride), quaternary ammonium salts such as poly (2-methacryloxyethyltrimethyl ammonium chloride), poly (2-hydroxyoxy-3-methacryloxypropyltrimethyl ammonium chloride), poly (N-acrylamidepropyl-3-trimethyl ammonium chloride), poly (N-methylvinyl pyridinium chloride), poly (N-vinyl-2, 3-dimethyl imidazolinium chloride), poly (diallyl ammonium chloride) and poly (N,N-dimethyl-3,5-methylene piperidinium chloride), sulfonium such as poly (2-acryloxyethyl dimethyl sulfonium chloride) and phosphonium such as poly (glycidyl tributylphosphonium chloride); and anionic high molecular weight electrolytes such as poly (meth) acrylic acid, carboxylates (such as polyacrylate hydrolyzate, polyacrylic amide hydrolyzate and polyacrylic nitrile hydrolyzate), sulfonates such as plystyrene sulfonate and polyvinyl sulfonate), phosphonates (such as polyvinyl phosphonate).

If the conductive layer contains such binder and conductive agent, the conductive layer can be readily coated on the support and a volume electric resistance can be controlled, so that an original plate for lithographic printing prepared using this conductive layer can be readily handled. Such a conductive layer is preferably a styrene-butadiene copolymer or an acrylic resin each having added thereto carbon black or whisker of conductive titanium oxide.

A thickness of such a conductive layer, although varying depending upon its material, a kind of a conductive agent to be mixed and an amount of the same, is generally 0.5 to 10 $\mu$m, and preferably 2 to 5 $\mu$m. Further, the conductive agent generally is generally a particle having a particle size of about 0.01 to 5 $\mu$m, and a content thereof is generally about 3 to 11 wt %.

Adhesion or coating can be used as a method for providing a conductive layer on a support. The coating method is preferably used where a mixture comprising the resin material and the conductive agent is applied to a support. The coating method which can be used is the conventional methods such as bar coating method, roll coating methods such as gravure and reverse, doctor knife method, air knife and nozzle coating method. When the adhesion between the support and conductive layer is poor, the surface of the support may be subjected to corona discharge or chemical pretreatment. Further, in order to improve the adhesion between the support and the conductive layer, an interlayer can be provided therebetween.

A blocking layer is preferably provided between the conductive layer and the photoconductive layer. This blocking layer has a function for preventing charge and/or electrons from moving. Thus, it is effective to improve charging efficiency and to prevent non-uniform charging. Such a blocking layer is a resin which can form a uniform film and is suitable for the blocking layer, and is appropriately selected from the above-described resins used in the conductive layer. The preferable resin is, for example, methyl polymethacrylate or polyacrylonitrile. Namely, the solution thereof is coated and dried to form a blocking layer of such a resin.

The blocking layer has an electric resistance of preferably $1\times10^{10}$ Ω·cm or more, and more preferably $1\times10^{11}$ Ω·cm or more. Although the upper limit thereof is not particularly limited, it is generally about $1\times10^{14}$ Ω·cm. The blocking layer generally has a thickness of about 0.2 to 2 $\mu$m. A method of providing the blocking layer on the conductive layer is the same as that of the conductive layer.

The photoconductive layer can be one generally used in an original plate for lithographic printing in an electrophotographic method. A layer comprising a binder having zinc oxide (ZnO) dispersed therein is generally used.

The particle size of zinc oxide is generally about 0.1 to 0.5 $\mu$m. The binder is not particularly limited, and materials having desirable mechanical and electrical property can be used as the binder. Examples of the binder which can be used include polystyrene, polyacrylic acid, polymethacrylate, polyvinyl acetate, polyvinyl chloride, polyvinyl butyral and the derivatives thereof, a polyester resin, an acrylic resin, an epoxy resin and silicone resin. Of those, the acrylic resin is preferable. A mixing ratio of the pigment and binder is generally about 3:1 to 20:1 in weight ratio. The coating amount of the photoconductive layer is generally about 15 to 30 g/m$^2$. A thickness of the photoconductive layer is preferably 5 to 30 $\mu$m. A method of providing the photoconductive layer on the blocking layer or on the conductive layer is the same as that of the conductive layer.

A back coat layer can further be provided on the side opposite the photoconductive layer of the support. This back coat layer functions as a sliding prevention layer or optionally for controlling conductivity. This layer has such a construction that the conductive agent and particles for controlling rigidity (particle size: about 0.1 $\mu$m to 1 $\mu$m) are uniformly dispersed in a polymer binder.

Example of the polymer for the binder which can be used include polyethylene, polybutadiene, polyacrylate, polymethacrylate, polyamylose acetate, nylon, polycarbonate, polyvinyl fumarate, polyvinyl acetate, polyacenaphthylene, polyisoprene, polyethylene, polyethylene terephthalate, polyvinyl chloride, polyoxyethylene, polypropylene oxide, polytetrahydrofuran, polyvinyl alcohol, polyphenylene oxide and polypropylene, copolymers thereof or a hardened gelatin or polyvinyl alcohol.

A constitutional example of a lithographic printing plate used in the present invention will be explained below by reference to the accompanying drawings.

FIG. 1 is a cross sectional view showing a constitutional example of a lithographic printing plate used in the present invention. In FIG. 1, an original plate for lithographic printing successively comprises a support 2, a conductive layer 3, a blocking layer 4, and a photoconductive layer 5. The photoconductive layer 5 charged according to a given procedure is exposed to light and developed, whereby a toner image 6 is formed. A desensitizing treatment is conducted to the formed image to form a lithographic printing plate.

A method for producing the lithographic printing plate according to the present invention is described below.

Figure 2:
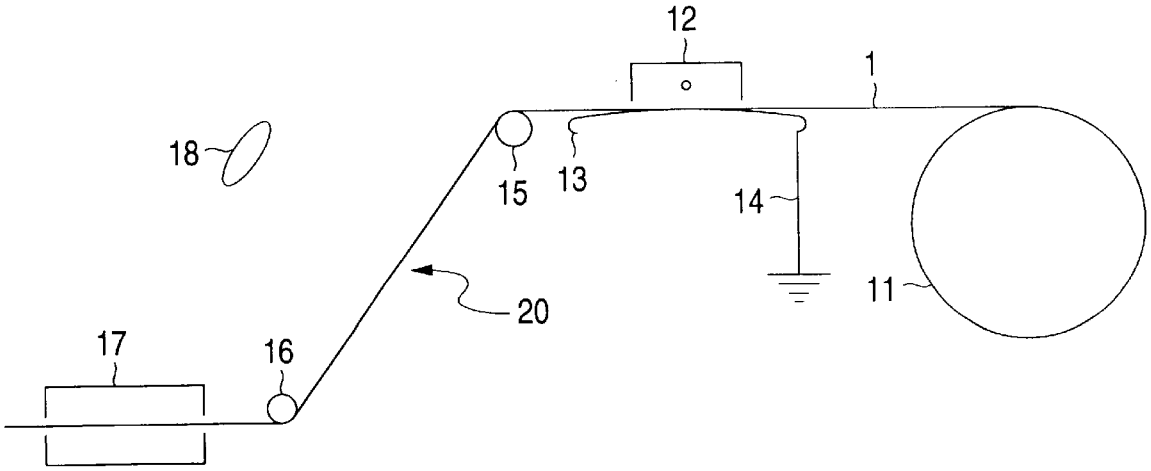
FIG. 2 is a schematic view showing the production process (apparatus) of the lithographic printing plate according to the present invention.

FIG. 2 is a schematic view showing a production process (apparatus) of the lithographic printing plate. In this drawing, an original plate for lithographic printing (hereinafter referred to as a "master") 1 is supplied from a paper supplying part 11 by a carrying means, and then negatively and positively charged above and below a photoconductive layer 3 by a negative corona discharge unit 12 and a conductor 13 which is grounded by a conductor 14 and has earth potential, respectively. The conductor 13 is contacted with the support 2 of the master 1 to function as an earth electrode and also as the carrying guide of the master 1. The support 2 has a volume electric resistance of more than $1\times10^{10}$ Ω·cm, so that the conductive layer 3 and the conductor 13 are substantially electrically insulated to each other. However, when a negative corona discharge unit 12 operates, an atmospheric discharge phenomenon occurs, because the distance between the conductor 13 and the conductive layer 3 is short, i.e., the distance substantially corresponds to the thickness of the support 2. Thus, the master 1 is charged. The conductor 13 which can be used is metals such as iron, copper and aluminum, alloys such as stainless steel, products thereof surface treated with nickel or chromium, carbon resin and conductive substance-including resin materials, each preferably having a volume electric resistance of $1\times10^{3}$ Ω·cm or less. Although the thickness of the conductor is appropriately determined depending upon the material or a structure of a plate making apparatus, it is generally about 0.1 to 5 mm. The size thereof can be determined corresponding to the size of the corona discharge unit (charger) used or the master 1.

An electrical voltage to be applied for corona discharge is preferably −4 to −10 KV, and more preferably −5.5 to −6.5 KV. The master (original plate for electrophotographic lithographic printing) 1 passes through under the corona discharge unit at a rate of preferably 1 to 50 cm/sec, and more preferably 5 to 20 cm/sec.

The master 1 is imagewise exposed by laser beam or incadescent light bundled by a lens 18 in an exposure part 20 positioned between guide rollers 15 and 16 to form an image. By this procedure, the charge in the exposed area disappears and only the charge in the unexposed area remains. This exposed master 1 is carried to a developing and fixing part 17 by a carrying means, where toner is adhered to the unexposed area, whereby the master 1 is developed, and the developed image is fixed. Thereafter, hydrophilic treatment is applied thereto, followed by drying, to produce a lithographic printing plate. A liquid toner is generally used as the toner.

Desensitizing zinc oxide is conducted using the conventional desensitizing treating liquids for such a desensitizing treatment. Examples of the desensitizing treating liquid include cyanide-containing treating liquid mainly comprising ferrocyanide or ferricyanide, cyanide free treating liquid mainly comprising amine cobalt complex, phytic acid and the derivatives thereof, guanidine derivatives, treating liquid mainly comprising an inorganic acid or organic acid which forms chelate with zinc ion, and water-soluble polymer containing treating liquid.

Examples of the cyanide-containing treating liquid are those as described in, for example, JP-B-44-9045, 46-39403 and JP-A-52-76101, 57-107889, and 54-117201.

Examples of the phytic acid type compound-containing treating liquid are those as described in, for example, JP-A-53-83807, 53-83805, 53-102102, 53-109701, 53-127003, 54-2803, and 54-44901.

Examples of the cobalt complex-containing treating liquid are those as described in, for example, JP-A-53-104301, 53-140103, and 54-18304, and JP-B-43-28404.

Examples of the inorganic or organic acid-containing treating liquid are those as described in, for example, JP-B-39-13702, 40-10308, 43-28408 and 40-26124, and JP-A-51-18501.

Examples of the guanidine-containing treating liquid are those as described in, for example, JP-A-56-111695.

Examples of the water-soluble polymer containing treating liquid are those as described in, for example, JP-A-52-126302, 52-134501, 53-49506, 53-59502 and 53-104302, and JP-B-38-9665, 39-22263, 40-763, 40-2202 and JP-A-49-36402.

In any desensitizing treatment, it is considered that zinc oxide in a surface layer is ionized to be a zinc ion, this zinc ion causes a chelating reaction with a chelate forming compound in the desensitizing treating liquid to form a zinc chelating compound, and this compound is deposited on the surface layer, making the surface of the photoconductive layer.

The desensitizing treatment is generally conducted at room temperature (about 15 to 35° C.) for about 0.5 to 30 seconds. Offset printing of about 3000 sheets can be performed with dampening water using this printing sheet.

Figure 3:
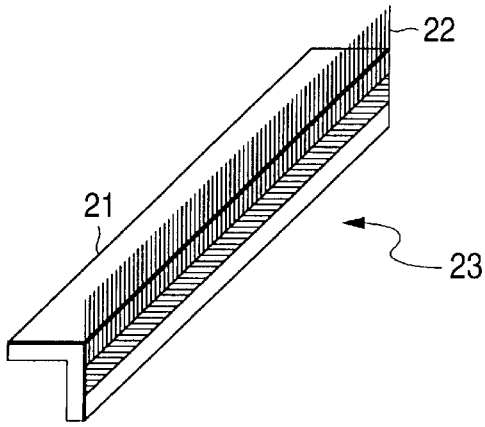
FIG. 3 is a perspective view showing a constitutional example of an auxiliary conductor used together with a conductor.
Figure 4:
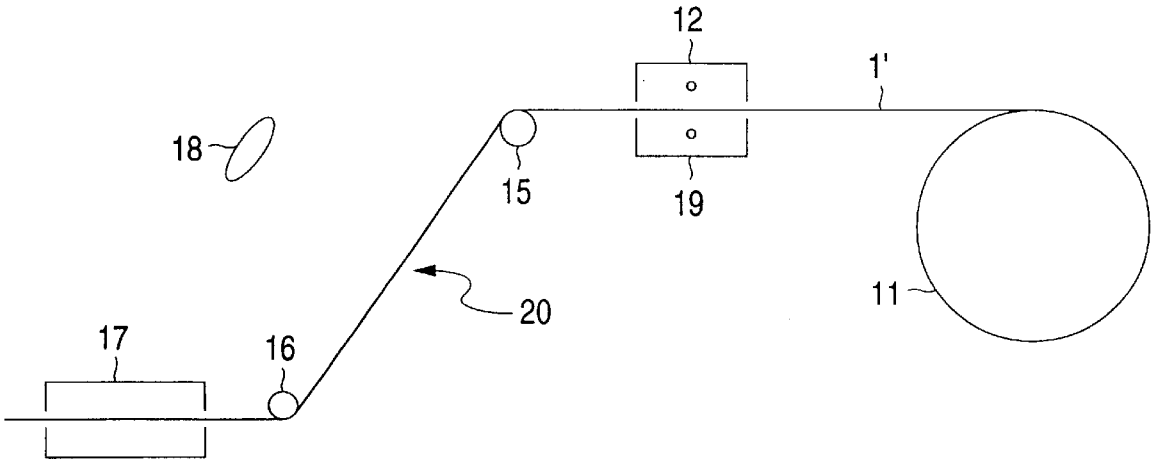
FIG. 4 PRIOR ART
FIG. 4 is a perspective view showing the production process (apparatus) of a conventional lithographic printing plate.

In addition to the conductor 13, a brush grounded as in the conductor 13 or a conductor in the form of a brush is arranged before and/or after the corona discharge unit 12 or the conductor 13, and is directly contacted with the conductive layer 3 of the master 1, whereby the conductive layer may be charged. Namely, as shown in FIG. 3, many fibers or bars of the conductor are arranged upright on a metallic support 21 to form a brush 22. This brush may be used as an auxiliary conductor 23 and contacted with the side surface of the master 1. Alternatively, conductive fibers may be arranged upright at a high density over the entire surface of the conductor. By this constitution, it is possible to more readily charge, no limitation is posed on the thickness of the support 2, the carrying speed can be increased, and non-uniform charging can be decreased.

The present invention will be further described in more detail by reference to the following Examples. It should however be understood that the invention is not construed as being limited thereto.

EXAMPLE 1

Preparation of Conductive Layer

Corona discharge treatment was applied to one surface of a polyethylene terephthalate film having a thickness of 125 μm and a volume electric resistance of $2\times10^{15}$ Ω·cm. Each of dispersion coating liquids D1 to D10 having the following composition 1 was applied on the surface as a conductive layer. In this application, an addition amount of carbon black was varied so as to have a volume electric resistance as shown in Table 1. The conductive layer was coated with a wire bar such that the dry coating weight was 7 g/m$^2$. The coated product was dried in an atmosphere of 120° C. for one minute to obtain Sample Nos. D1 to D10.

Composition 1

| | Parts by weight |
|---|---|
| Styrene butadiene latex (solid content 50 wt %) | 10 |
| Carbon black (average particle size of 25 μm) | 1 to 11 |
| Clay (aqueous dispersion having a solid content of 45 wt %) | 100 |
| Water | 35 |
| Melamine | 3 |

Preparation of Blocking layer

A blocking layer was prepared using a dispersion having the following composition 2. In the preparation, addition amounts of a water-soluble conductive agent, vinyl benzyl quaternary ammonium and carbon black were varied so as to have a volume electric resistance as shown in Table 2.

The blocking layer was coated with a wire bar such that the dry coating weight was 3 g/m$^2$. The coated product was dried in an atmosphere of 120° C. for one minute to obtain Sample Nos. B1 to B5.

Composition 2

| | Parts by weight |
|---|---|
| Styrene butadiene latex (solid content 50 wt %) | 30 |
| Starch | 1 |
| Carbon black (average particle size of 25 μm) | 0 to 6 |
| Vinyl benzyl quaternary ammonium (10 wt % aqueous solution) | 0 to 20 |
| Clay (aqueous dispersion having a solid content of 45 wt %) | 100 |
| Water | 90 |

The volume electric resistance of the conductive layer and the blocking layer was determined according to the following method.

Each of liquids having the above-described each composition was coated on a stainless steel plate at the same coating thickness as that of the respective sample, followed by drying. Gold was deposited on the coating film in the form of a circle having a diameter of 10 cm, and an electrical resistance between stainless steel and the gold deposited film was measured. A volume electric resistance was calculated from the thickness of this layer and the area of the gold deposited film. The results are shown in Tables 1 and 2.

TABLE 1

| Sample No. | Volume electric resistance (Ω · cm) |
|---|---|
| D1 | $1.1 \times 10^2$ |
| D2 | $3.9 \times 10^2$ |
| D3 | $6.3 \times 10^2$ |
| D4 | $9.2 \times 10^3$ |
| D5 | $2.1 \times 10^3$ |
| D6 | $8.4 \times 10^3$ |
| D7 | $4.2 \times 10^4$ |
| D8 | $5.5 \times 10^5$* |
| D9 | $1.3 \times 10^6$* |
| D10 | $7.4 \times 10^7$* |

*shows the outside of the range

TABLE 2

| Sample No. | Volume electric resistance (Ω · cm) |
|---|---|
| B1 | $9.3 \times 10^{10}$ |
| B2 | $2.2 \times 10^{11}$ |
| B3 | $8.5 \times 10^{11}$ |
| B4 | $4.2 \times 10^{12}$ |
| B5 | $7.3 \times 10^{12}$ |

Conductive layer samples D1 to D10 and blocking layer samples B1 to B5 prepared as above were combined, respectively, to obtain 50 kinds of samples. Those samples were coated with a dispersion for a photoconductive layer having the following composition 3 using a wire bar such that the solid coating weight was 25 g/m$^2$. The coated products were dried in an atmosphere at 100° C. for one minute, and allowed to stand in a dark room kept at 60% RH for 24 hours to obtain samples of an original plate for lithographic printing. The samples obtained were formed into printing plates using ELP-330 RX plate making machine, a product of Fuji Photo Film Co., Ltd. and the following four kinds of evaluations were made to the images obtained. The ELP-330 RX plate making machine is a so-called single corona charging method. Namely, as in the apparatus shown in FIG. 2, negative corona charging is performed from the side of a photosensitive (ZnO/binder) layer of a master surface, and the back side thereof is contacted with a grounded conductor, thereby charging.

Composition 3

| | Parts by weight |
|---|---|
| Photoconductive zinc oxide | 100 |
| Acrylic resin | 20 |
| Toluene | 125 |
| Phthalic anhydride | 0.1 |
| Rose bengal (4% methanol solution) | 4.5 |

(1) Solid part reflection density

Measured with a Mackbeth reflection densitometer (RD-517 model). The solid reflection density is preferably 100 or more.

(2) Non-image fog, D fog

Measured with a Mackbeth reflection densitometer (RD-517 model). D fog is preferably 0.08 or less.

(3) Non-uniform charging

Evaluated according to the following criteria.

○: A solid part of a 15 cm square is all uniform.

Δ: Non-uniform charging is slightly recognized in a solid part of a 15 cm square.

x: Non-uniform charging is apparently recognized in a solid part of a 15 cm square.

(4) Sharpness of image line

Evaluated according to the following criteria.

◎: Japanese character "長" of size 3.514 mm×3.514 mm is sharp and smooth in all parts.

○: One thick or thin Japanese character "長" of size 3.514 mm×3.514 mm is recognized.

Δ: More than one thick or thin Japanese character "長" of size 3.514 mm×3.514 mm are recognized.

x: At least one lacking of Japanese character "長" of size 3.514 mm×3.514 mm is present.

The results obtained are shown in Tables 3 to 7.

TABLE 3

(Sample B1)

| Sample No. | Solid reflection density Dm | Non-image fog Dfog | Non-uniform charging | Sharpness of image |
|---|---|---|---|---|
| D1 | 0.95 | 0.07 | ○ | ◎ |
| D2 | 0.95 | 0.07 | ○ | ◎ |
| D3 | 0.95 | 0.08 | ○ | ◎ |
| D4 | 0.96 | 0.08 | ○ | ◎ |
| D5 | 0.96 | 0.08 | ○ | ◎ |
| D6 | 0.97 | 0.08 | ○ | ◎ |
| D7 | 0.98 | 0.08 | ○ | ◎ |
| D8* | 0.98 | 0.11 | ○ | ◎ |
| D9* | 0.96 | 0.15 | ○ | ◎ |
| D10* | 0.96 | 0.19 | ○ | ◎ |

*shows the outside of the range

TABLE 4

(Sample B2)

| Sample No. | Solid reflection density Dm | Non-image fog Dfog | Non-uniform charging | Sharpness of image |
|---|---|---|---|---|
| D1 | 1.01 | 0.08 | ○ | ◎ |
| D2 | 1.01 | 0.08 | ○ | ◎ |
| D3 | 1.00 | 0.08 | ○ | ◎ |
| D4 | 1.00 | 0.08 | ○ | ◎ |
| D5 | 1.01 | 0.08 | ○ | ◎ |
| D6 | 1.01 | 0.08 | ○ | ◎ |
| D7 | 1.01 | 0.08 | ○ | ◎ |
| D8* | 1.00 | 0.10 | ○ | ◎ |
| D9* | 0.98 | 0.15 | ○ | ◎ |
| D10* | 0.96 | 0.26 | ○ | ◎ |

*shows the outside of the range

TABLE 5

(Sample B3)

| Sample No. | Solid reflection density Dm | Non-image fog Dfog | Non-uniform charging | Sharpness of image |
|---|---|---|---|---|
| D1 | 1.01 | 0.08 | ○ | ◎ |
| D2 | 1.01 | 0.08 | ○ | ◎ |
| D3 | 1.01 | 0.07 | ○ | ◎ |
| D4 | 1.01 | 0.08 | ○ | ◎ |
| D5 | 1.00 | 0.08 | ○ | ◎ |
| D6 | 1.00 | 0.08 | ○ | ◎ |
| D7 | 1.00 | 0.08 | ○ | ◎ |
| D8* | 0.99 | 0.13 | ○ | ◎ |
| D9* | 0.99 | 0.17 | ○ | ◎ |
| D10* | 0.97 | 0.29 | ○ | ◎ |

*shows the outside of the range

TABLE 6

(Sample B4)

| Sample No. | Solid reflection density Dm | Non-image fog Dfog | Non-uniform charging | Sharpness of image |
|---|---|---|---|---|
| D1 | 1.00 | 0.08 | ○ | ◎ |
| D2 | 1.00 | 0.08 | ○ | ◎ |
| D3 | 1.00 | 0.08 | ○ | ◎ |
| D4 | 1.01 | 0.08 | ○ | ◎ |
| D5 | 1.01 | 0.08 | ○ | ◎ |
| D6 | 1.01 | 0.08 | ○ | ◎ |
| D7 | 1.01 | 0.09 | ○ | ◎ |
| D8* | 0.99 | 0.14 | ○ | ◎ |
| D9* | 0.99 | 0.19 | ○ | ◎ |
| D10* | 0.97 | 0.33 | ○ | ◎ |

*shows the outside of the range

TABLE 7

(Sample B5)

| Sample No. | Solid reflection density Dm | Non-image fog Dfog | Non-uniform charging | Sharpness of image |
|---|---|---|---|---|
| D1 | 1.01 | 0.08 | ○ | ◎ |
| D2 | 1.00 | 0.08 | ○ | ◎ |

TABLE 7-continued (Sample B5)

| Sample No. | Solid reflection density Dm | Non-image fog Dfog | Non-uniform charging | Sharpness of image |
|---|---|---|---|---|
| D3 | 1.00 | 0.08 | ○ | ◎ |
| D4 | 1.01 | 0.08 | ○ | ◎ |
| D5 | 1.02 | 0.08 | ○ | ◎ |
| D6 | 1.01 | 0.08 | ○ | ◎ |
| D7 | 1.02 | 0.09 | ○ | ◎ |
| DB* | 0.99 | 0.15 | ○ | ◎ |
| D9* | 0.98 | 0.22 | ○ | ◎ |
| D10* | 0.97 | 0.34 | ○ | ◎ |

*shows the outside of the range

EXAMPLE 2

A plate making was conducted using the sample used in Example 1 by an auxiliary conductor shown in FIG. 3 in combination with the apparatus of Example 1 shown in FIG. 2. As a result, printing property was further improved as compared with Example 1.

EXAMPLE 3

Plate making and evaluation were conducted in the same manner as in Examples 1 and 2 except that a double-sided laminate paper (volume electric resistance: $4.1\times10^{11}$ Ω·cm) composed of a paper having a thickness of 146 μm and a polyethylene laminate resin having a thickness of 27 μm was used in place of the polyethylene terephthalate film having a thickness of 125 μm used in Example 1. As a result, the same results as in Examples 1 and 2 were obtained.

EXAMPLE 4

Plate making and evaluation were conducted in the same manner as in Examples 1 and 2 except that a double-sided laminate paper (volume electric resistance: $2.8\times10^{10}$ Ω·cm) composed of a paper having a thickness of 65 μm and a polyethylene laminate resin having a thickness of 1.9 μm was used in place of the polyethylene terephthalate film having a thickness of 125 μm used in Example 1. As a result, the same results as in Examples 1 and 2 were obtained.

COMPARATIVE EXAMPLE 1

The same sample of the original plate for lithographic printing as that of Example 1 was subjected to plate making using an ELP-404V plate making machine, a product of Fuji Photo Film Co., Ltd. and the image obtained was evaluated in the same manner as in Example 1.

The ELP-404V plate making machine is a so-called double corona charging method wherein negative corona charging is effected from the side of a photosensitive (ZnO/binder) layer of a master surface and positive corona charging is effected from the back side thereof.

The results obtained are shown in Tables 8 to 12.

TABLE 8

(Sample B1)

| Sample No. | Solid reflection density Dm | Non-image fog Dfog | Non-uniform charging | Sharpness of image |
|---|---|---|---|---|
| D1 | 0.95 | 0.14 | x | Δ |
| D2 | 0.94 | 0.14 | x | Δ |
| D3 | 0.94 | 0.15 | x | Δ |

TABLE 8-continued (Sample B1)

| Sample No. | Solid reflection density Dm | Non-image fog Dfog | Non-uniform charging | Sharpness of image |
|---|---|---|---|---|
| D4 | 0.96 | 0.16 | x | Δ |
| D5 | 0.96 | 0.18 | x | Δ |
| D6 | 0.98 | 0.18 | x | Δ |
| D7 | 0.98 | 0.22 | x | Δ |
| D8* | 0.98 | 0.26 | x | Δ |
| D9* | 0.97 | 0.33 | x | x |
| D10* | 0.96 | 0.39 | x | x |

*shows the outside of the range

TABLE 9

(Sample B2)

| Sample No. | Solid reflection density Dm | Non-image fog Dfog | Non-uniform charging | Sharpness of image |
|---|---|---|---|---|
| D1 | 0.95 | 0.12 | x | Δ |
| D2 | 0.95 | 0.13 | x | Δ |
| D3 | 0.97 | 0.15 | x | Δ |
| D4 | 0.97 | 0.15 | x | Δ |
| D5 | 0.99 | 0.17 | x | Δ |
| D6 | 0.99 | 0.18 | x | Δ |
| D7 | 0.98 | 0.22 | x | Δ |
| D8* | 0.97 | 0.27 | x | x |
| D9* | 0.96 | 0.33 | x | x |
| D10* | 0.96 | 0.41 | x | x |

*shows the outside of the range

TABLE 10

(Sample B3)

| Sample No. | Solid reflection density Dm | Non-image fog Dfog | Non-uniform charging | Sharpness of image |
|---|---|---|---|---|
| D1 | 0.96 | 0.13 | x | Δ |
| D2 | 0.98 | 0.13 | x | Δ |
| D3 | 0.98 | 0.15 | x | Δ |
| D4 | 0.98 | 0.18 | x | Δ |
| D5 | 0.99 | 0.21 | x | Δ |
| D6 | 0.98 | 0.22 | x | Δ |
| D7 | 0.97 | 0.27 | x | Δ |
| D8* | 0.96 | 0.31 | x | x |
| D9* | 0.96 | 0.35 | x | x |
| D10* | 0.96 | 0.44 | x | x |

*shows the outside of the range

TABLE 11

(Sample B4)

| Sample No. | Solid reflection density Dm | Non-image fog Dfog | Non-uniform charging | Sharpness of image |
|---|---|---|---|---|
| D1 | 0.97 | 0.13 | x | Δ |
| D2 | 0.98 | 0.15 | x | Δ |
| D3 | 0.98 | 0.16 | x | Δ |
| D4 | 0.98 | 0.19 | x | Δ |
| D5 | 0.98 | 0.23 | x | Δ |

TABLE 11-continued (Sample B4)

| Sample No. | Solid reflection density Dm | Non-image fog Dfog | Non-uniform charging | Sharpness of image |
|---|---|---|---|---|
| D6 | 0.98 | 0.25 | x | Δ |
| D7 | 0.98 | 0.31 | x | x |
| D8* | 0.97 | 0.37 | x | x |
| D9* | 0.97 | 0.44 | Δ | x |
| D10* | 0.97 | 0.51 | Δ | x |

*shows the outside of the range

TABLE 12

(Sample B5)

| Sample No. | Solid reflection density Dm | Non-image fog Dfog | Non-uniform charging | Sharpness of image |
|---|---|---|---|---|
| D1 | 1.00 | 0.13 | x | Δ |
| D2 | 1.00 | 0.17 | x | Δ |
| D3 | 0.99 | 0.19 | x | Δ |
| D4 | 0.98 | 0.23 | x | Δ |
| D5 | 0.99 | 0.31 | x | x |
| D6 | 0.99 | 0.39 | x | x |
| D7 | 0.97 | 0.42 | x | x |
| D8* | 0.98 | 0.44 | x | x |
| D9* | 0.97 | 0.51 | — | x |
| D10* | 0.97 | 0.57 | — | x |

*shows the outside of the range

As described above, the present invention can provide a process for producing a lithographic printing plate which is inexpensive, is not elongated, can be readily handled and can form a uniform image without non-uniformity of charging.

While the invention has been described in detail and with reference to specific embodiments thereof, it will be apparent to one skilled in the art that various changes and modification can be made therein without departing from the spirit and scope thereof.

What is claimed is:

1. A process for producing a lithographic printing plate, which comprises the steps of:

using an original plate for lithographic printing comprising a support having a volume electric resistance of more than $1\times10^{10}$ Ω·cm, a conductive layer having a volume electric resistance of $1\times10^{5}$ Ω·cm or less, provided on one surface of the support, and a photoconductive layer containing zinc oxide and a binder, provided on the conductive layer, conducting negative corona discharge from the side of the photoconductive layer of the original plate for lithographic printing, and during this corona discharge, contacting a conductor having earth potential and a thickness of about 0.1 to 5 mm with at least the support of the original plate, thereby charging the photoconductive layer of the original plate for lithographic printing.

* * * * *